US011381030B2

(12) United States Patent
Demaratos et al.

(10) Patent No.: US 11,381,030 B2
(45) Date of Patent: Jul. 5, 2022

(54) METHOD FOR ELECTROMAGNETIC INTERFERENCE (EMI) PROTECTION FOR A HIGH VOLTAGE CONNECTOR ASSEMBLY HAVING A HIGH VOLTAGE VERTICAL DISK FERRULE

(71) Applicant: J.S.T. CORPORATION, Farmington Hills, MI (US)

(72) Inventors: David Demaratos, Wixom, MI (US); Joshua Taylor, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/119,757

(22) Filed: Dec. 11, 2020

(65) Prior Publication Data

US 2022/0021161 A1 Jan. 20, 2022

Related U.S. Application Data

(60) Provisional application No. 63/051,517, filed on Jul. 14, 2020.

(51) Int. Cl.
*H01R 13/53* (2006.01)
*H01R 13/6591* (2011.01)
(Continued)

(52) U.S. Cl.
CPC ..... *H01R 13/53* (2013.01); *H01R 13/405* (2013.01); *H01R 13/6583* (2013.01); *H01R 13/65912* (2020.08); *H01R 13/65914* (2020.08)

(58) Field of Classification Search
CPC ..... H01R 13/658; H01R 13/6581; H01R 13/6592; H01R 13/65914
See application file for complete search history.

(56) References Cited

U.S. PATENT DOCUMENTS 4,382,653 A * 5/1983 Blanchard ..... H01R 13/6588 439/607.41
10,193,281 B1 * 1/2019 Rossman ..... H01R 13/658
(Continued)

FOREIGN PATENT DOCUMENTS

EP 0295154 B1 6/1992

OTHER PUBLICATIONS

International Search Report for International Application No. PCT/US2020/064853 dated Mar. 16, 2021 (2 sheets).
(Continued)

*Primary Examiner* — Renee S Luebke
*Assistant Examiner* — Paul D Baillargeon
(74) *Attorney, Agent, or Firm* — Kratz, Quintos & Hanson, LLP

(57) ABSTRACT

A method for reducing the effect of electromagnetic interference (EMI), providing EMI protection to a connector assembly, using at least one vertical disk ferrule. The method includes steps of providing a flared portion, first portion, of a wire shield to at least a vertical disk ferrule, or affixing between two of said vertical disk ferrules. Further, one of a step of providing a ferrule having a face which contacts a metallic connector housing directly; or providing the flared portion of the wire shield which contacts said metallic connector housing directly; wherein said EMI is conducted from said metallic connector housing to said ferrule or flared portion, further conducting said EMI to said flared portion of the wire shield, further conducting said EMI through a second portion of said wire shield, further conducting said EMI to ground; said EMI being generated by at least the metallic connector housing.

13 Claims, 5 Drawing Sheets

(51) Int. Cl.
*H01R 13/405* (2006.01)
*H01R 13/6583* (2011.01)

(56) References Cited

U.S. PATENT DOCUMENTS

| | | | |
|---|---|---|---|
| 2004/0102090 | A1 | 5/2004 | Styles |
| 2013/0236139 | A1 | 9/2013 | Chen |
| 2015/0332809 | A1 | 11/2015 | Natoli |

OTHER PUBLICATIONS

International Preliminary Report on Patentability for International Application No. PCT/JP2020/064853 dated Nov. 20, 2021 (5 sheets).

* cited by examiner

METHOD FOR ELECTROMAGNETIC INTERFERENCE (EMI) PROTECTION FOR A HIGH VOLTAGE CONNECTOR ASSEMBLY HAVING A HIGH VOLTAGE VERTICAL DISK FERRULE

CROSS-REFERENCE TO RELATED APPLICATION

This patent application claims priority to U.S. Provisional Patent Application No. 63/051,517 filed. Jul. 14, 2020, which is hereby incorporated herein by reference in its entirety.

BACKGROUND OF THE INVENTION

Electromagnetic interference (EMI) affects an electrical circuit due to a disturbance, from a source, by electromagnetic induction, electrostatic coupling or conduction. EMI may degrade the performance of a circuit or may even stop it from functioning. In the case where the circuit includes a data path, EMI may affect the effectiveness of the data path due to an increase in error rate to the total loss of the data. A source that may generate changing electrical currents and voltage that may cause EMI may include, for example, automotive injection systems, mobile phone cellular network, or the like. It is thus essential to manage the generation of EMI to avoid the detrimental effects caused by it; and to consequently maximize the effectiveness of an electrical circuit that may otherwise be vulnerable to the detrimental effects of EMI.

Ways to avoid or reduce the detrimental effects of EMI include conduction, shielding, or the like. EMI protection by conduction is achieved by the conduction of EMI between conductive elements or conductors that are in physical contact, while EMI protection by shielding is achieved by shielding radiated EMI by induction (i.e., the absence of physical contacts of conductors). In a connector assembly, conducted EMI is directed through a path of adjoining conductive elements or conductors and towards a device onto which the connector assembly is attached or mounted, the device acting as ground.

It is thus desired that the structure or structural arrangement of a ferrule, employed in the high voltage connector of this invention, can provide complete or substantial EMI coverage by covering the hole in a respective housing which allows for full coverage inside the opening of the respective connector housing which it is being used with, as well as a ferrule, which when affixed with a wire braided shield, does not require a secondary cut which therefore minimizes or reduces the likelihood that stray strands of the wire braided shield (ground circuit) contacting the wire core (power circuit), and also a ferrule that provides a forgiving take up or tolerance to enhance the assembly method thereof.

SUMMARY OF THE INVENTION

This invention is directed to a method for reducing the effect of electromagnetic interference (EMI) by providing EMI protection to a high voltage connector assembly, which employs a high voltage vertical disk ferrule having different embodiments. The high voltage vertical disk ferrule of the high voltage connector assembly is a vertical disk-like structure; the disk-like structure is primarily made of flat surfaces; and the perimeter, edge, or vertical shape or constraint thereof is not necessarily round or does not necessarily have any roundness. The high voltage vertical disk ferrule of the high voltage connector is an electrically conducting device with an aperture or opening at the center thereof. The aperture or hole resides over the wire core and a wire braided shield, to which an end portion of the wire braided shield is affixed thereto the high voltage vertical disk ferrule, or between the ferrules, such that a portion of the wire braided shield is flared and substantially perpendicular to the direction of the wire core. The aperture or hole at the center of the high voltage vertical disk ferrule accommodates therein a wire core, wire core insulation, and\or a wire braided shield; the wire braided shield lying over the wire core insulation.

The vertical disk ferrule of the high voltage connector assembly slides over the core insulation, once affixed to the wire braided shield, towards the point or location where the outer insulation is cut (vertical surface of the outer insulation). The wire braided shield is pushed back and allows for the wire braided shield to develop a natural spring force against the vertical disk ferrule, and the wire braided shield becomes in the condition or state where it has compressed, accordioned, pleated, or folded against itself, and therefore pushes back against the direction the ferrule has traveled along the wire core when the wire is being pushed, so as to push the vertical disk ferrule forward (towards the cut end of the wire or terminal that is attached thereto). This force allows the high voltage vertical disk ferrule or wire braided shield of the high voltage connector assembly, if therebetween, to remain in contact with the grounding structure of the high voltage connector assembly when in use or when as a single high voltage vertical disk ferrule, pushes the wire braided shield against the housing or ferrule when in use.

The ability of the structural arrangements, in different embodiments, of the high voltage disk-like structure of the high voltage vertical disk ferrule of the high voltage connector assembly to take on any shape to which it can be stamped allows for it to provide complete or near complete electromagnetic interference (EMI) coverage in use with a corresponding metallic connector housing which may require a specific shape, and which further allows for little or no escape path for the EMI by covering the aperture or hole through which the wire or terminal is placed into when in use with such corresponding metallic connector housing in which the wire or terminal is inserted into, unlike in conventional ferrules and conventional stamped shields which may allow for EMI escape.

The high voltage vertical disk ferrule of the high voltage connector assembly in this invention also provides for an adequate clearance between the wire core or terminal (power circuit), and the wire braid shield or ferrule (grounding circuit), while also limiting the likelihood of contact between the power circuit and grounding circuit in the process by also limiting the likelihood of stray strands of the wire braid shield from contacting the power circuit.

In, for example, embodiments of this invention in which at least one high voltage vertical disk ferrule directly abuts the, e.g., the metallic connector housing that houses the terminal, the generated EMI passes from the metallic connector housing to the at least one high voltage vertical disk ferrule, and into the flared portion of the wire braided shield. The path of the EMI further travels from the flared portion of the wire braided shield to and passes through the compressed, accordioned, pleated, or folded portion of the wire braided shield, and the path of the EMI is ultimately directed from the compressed, accordioned, pleated, or folded portion of the wire braided shield to ground. Alternatively, in this embodiment of the invention, two high voltage vertical disk ferrules are provided with the flared portion of the wire braided shield sandwiched therebetween, and one of the high voltage vertical disk ferrules directly abuts and contacts the metallic connector housing.

In, for example, another embodiment of this invention, the flared portion of the wire braided shield directly abuts the metallic connector housing, while the high voltage vertical disk ferrule directly abuts and contact the flared portion of the wire braided shield. In this embodiment, the generated EMI has a path that travels from the metallic connector housing directly to the flared portion of the wire braided shield, passes therethrough, and into the compressed, accordioned, pleated, or folded portion of the wire braided shield, and the path of the EMI is ultimately directed from the compressed, accordioned, pleated, or folded portion of the wire braided shield to ground.

DETAILED DESCRIPTION OF THE PREFERRED EMBODIMENTS

Figure 1:
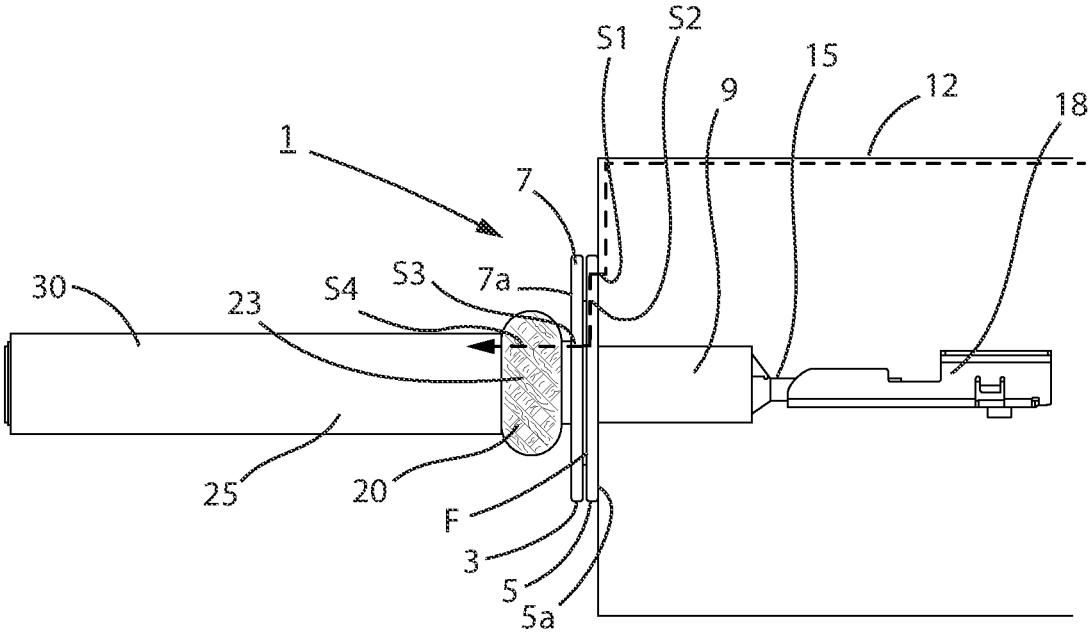
FIG. 1 shows the EMI path along the high voltage connector assembly, which employs a first embodiment of the high voltage vertical disk ferrule, shown in a side elevational view.

The high voltage connector assembly of this invention, generally referred to as reference number 1 in FIG. 1, employs the first embodiment of the high voltage vertical disk ferrule 3. The first embodiment of the high voltage vertical disk ferrule 3 includes at least a first high voltage vertical disk ferrule 5 with a front face 5*a* thereof, and a second first high voltage vertical disk ferrule 7 with a back face 7*a* thereof. As more fully discussed below, the first high voltage vertical disk ferrule 5 and the second high voltage vertical disk ferrule 7 are mounted onto a wire core insulation 9, which extends into a metallic container housing 12. In addition to the wire core insulation 9, also inside the metallic container housing 12 are a wire core 15 and a terminal 18 connected thereto. Adjacent the first embodiment of the high voltage vertical disk ferrule 3 is a wire braided shield 23, which as more fully discussed below, includes a compressed, accordioned, pleated, or folded portion 20 of the wire braided shield 23. At one end of the compressed, accordioned, pleated, or folded portion 20 of the wire braided shield 23 is an outer insulation 25 of a wire 30. The terminal 18, the wire core 15, the wire core insulation 9, the vertical disk ferrule 3 (with its first and second high voltage disk ferrules 5, 7) of the first embodiment, the outer insulation 25, and the wire 30 are all connected together to form the high voltage connector assembly 1.

Figure 6:
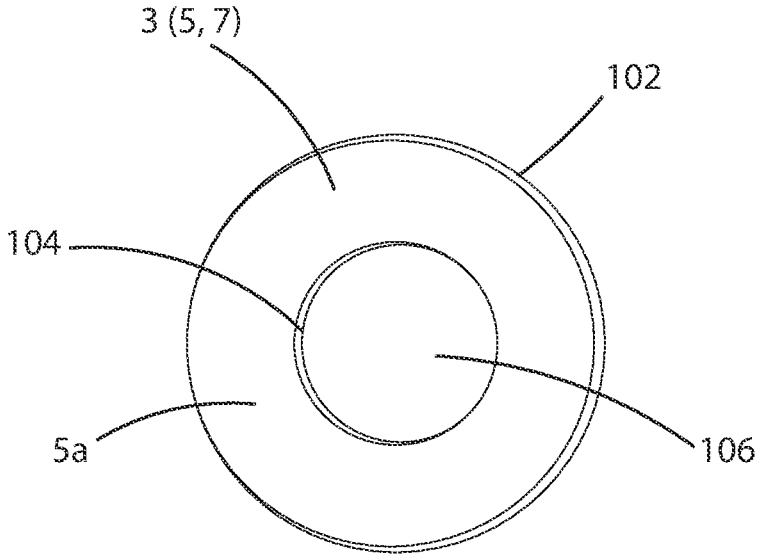
FIG. 6 is a front elevational view of a high voltage vertical disk ferrule employed in the high voltage connector of the present invention.

The high voltage vertical disk ferrule 3 (5, 7) may be made of any electrically conducting material (such as, but not limited to, copper, tin plated copper, steel, brass alloy, bronze, or the like, or any like-kind of conductive metal known in metallurgy). The high voltage vertical disk ferrule 3 (5, 7) is, as shown in FIG. 6, is comprised of an outer edge 102, an inner edge 104, defining an opening or aperture 106, and additionally the front face 5*a* which is flat, and a back face 7*a* which is also flat. The first high voltage vertical disk ferrule 5 and the second high voltage vertical ferrule 7, which make up the high voltage vertical disk ferrule 7 of the first embodiment of the first embodiment of the high voltage connector assembly 1 of this invention may be substantially identical in structure. Preferably, the outer edge 102 and the front face 5*a* meet perpendicularly, and similarly, the outer edge 102 and the rear face 7*a* meet perpendicularly. Furthermore, the inner edge 104 and the front face 5*a* meet perpendicularly, and similarly, the inner edge 104 and the rear face 7*a* meet perpendicularly. Thus, the distance or length of the outer edge 102 and the inner edge 104, in a direction parallel, or axial to the wire 30 defines the thickness or length of the high voltage vertical disk ferrule 100 employed in the high voltage connector assembly 1 (30, 60) of this invention (see, FIGS. 1, 2, and 4).

Figure 7:
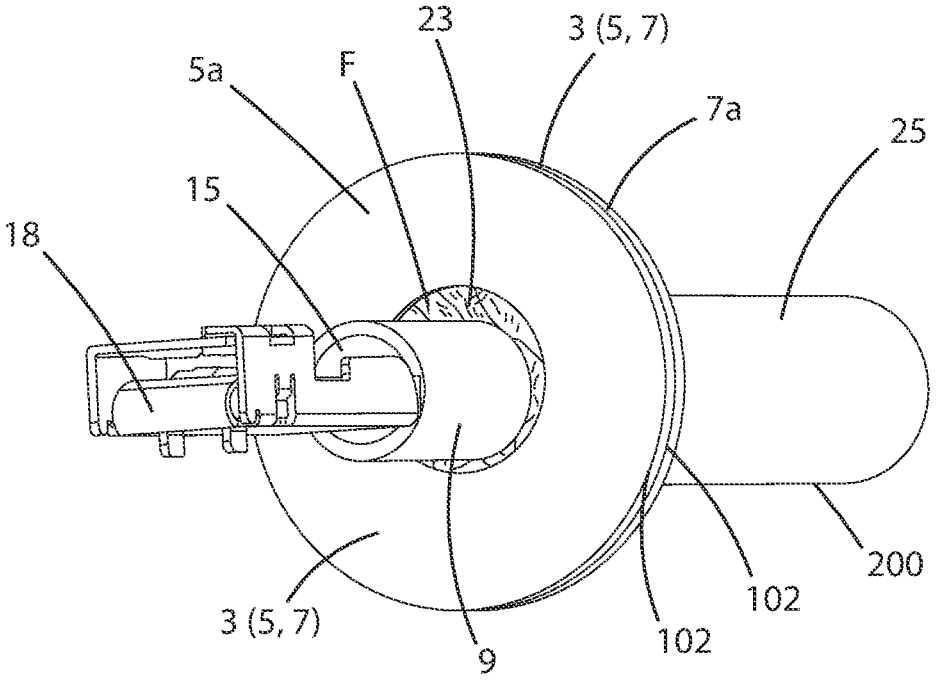
FIG. 7 is a perspective view of the high voltage vertical disk ferrule employed in the high voltage connector of the present invention using two high voltage vertical disk ferrules of the high voltage connector of present invention fully assembled with a wire.

Further, the high voltage vertical disk ferrule 3 (5, 7) employed in the high voltage connector 1 (30, 60) of this invention is preferably vertical disk-like structure, being a round, circular shape, although, the form is not limited thereto. The disk-like structure is primarily made of the vertical flat surfaces of the front face 5*a* and back face 7*a* and the perimeter, edge, or vertical shape constraints of the outer edge 102 is not necessarily formed to become round or does not necessarily have any roundness and is further able to take on any shape to which it can be stamped. For example, the shape of the vertical disk ferrule 3 (5, 7) could take the form of an oval, ellipse or any other shape allowable by stamping means which define the outer edge 102. Preferably, the shape of the vertical disk ferrule 3 (5, 7) will provide complete or substantial coverage over a corresponding hole or aperture (not shown) in a connector housing into which the related wire 30 or terminal 18 (see, FIGS. 1, 2, and 4) is attached and is required to pass through which is being used with the vertical disk ferrule 3 (5, 7). Thus, the shape of the vertical disk ferrule 3 (5, 7) will allow for it to provide complete or substantial electromagnetic interference (EMI) suppression or coverage when in use with the corresponding metallic connector housing 12 (see, FIGS. 1, 2, and 4). The corresponding metallic connector housing 12 itself may require the vertical disk ferrule 3, (5, 7) to be a specific shape to fit into a recess or cavity thereof (not shown). (See, in FIGS. 6 and 7, which illustrate the substantially circular shaped vertical disk ferrule 3 (5, 7), having its front face 5*a* and its back face 7*a* radiate outward, vertically, from its opening 106 and the respective wire 30 which is inserted and accommodated through the opening 106.)

Figure 2:
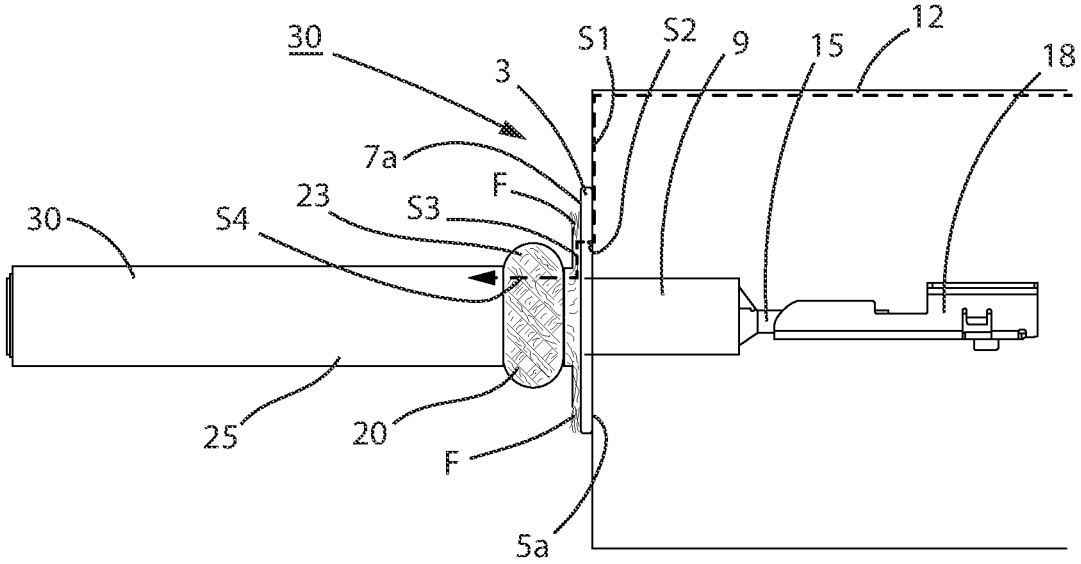
FIG. 2 shows the EMI path along the high voltage connector assembly, which employs a second embodiment of the high voltage vertical disk ferrule, shown in a side elevational view.
Figure 4:
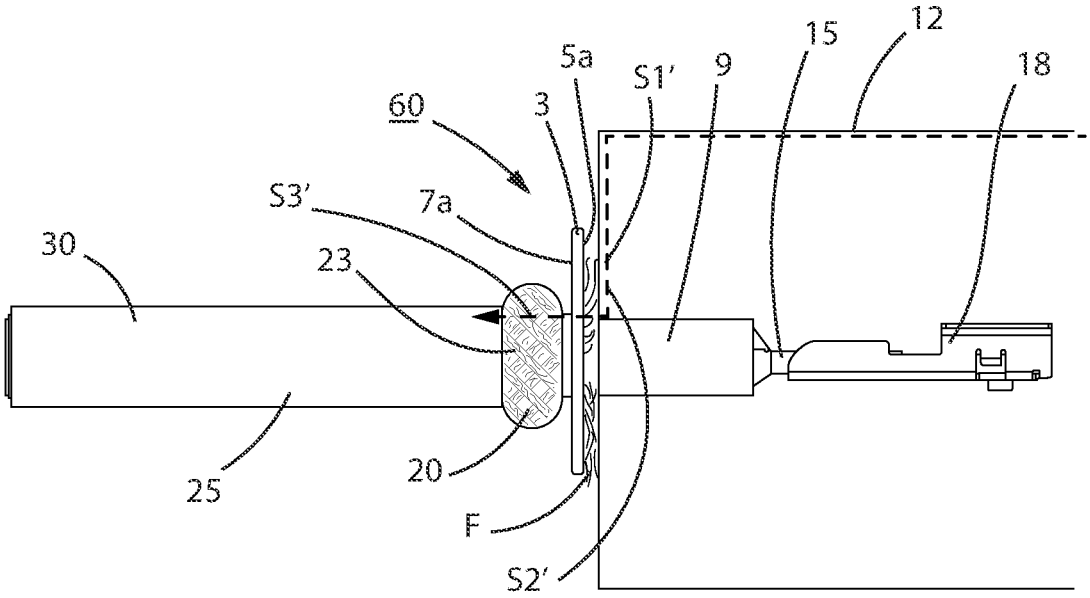
FIG. 4 shows the EMI path along the high voltage connector assembly, which employs a third embodiment of the high voltage vertical disk ferrule, shown in a side elevational view.

As shown in FIGS. 1, 2, and 4, the wire 30 is comprised of a wire core portion 15, wire core insulation 9, wire braided shield 23, and outer wire insulation 25. As previously discussed, the front face 5*a* and back face 7*a* of the vertical disk ferrule 3 (5, 7) are preferably generally perpendicular to the axial direction of the wire 30. The diameter or size of the front face 5*a* and back face 7*a* are such that the vertical disk ferrule 3 (5, 7) is large enough to cover a hole in a respective metallic connector housing 12, wherein the hole is large enough to accommodate a terminal 18 and a respective portion of the wire core 15 and/or wire core insulation 9. Therefore, the size of the front face 5*a* and back face 7*a* of the high voltage vertical disk ferrule 3 (5, 7) is not limited, and their respective sizes would however need to be such that they are not less than the size of the outer insulation 25 of the wire 30, so that the vertical disk ferrule 3 (5, 7) may have an inner edge 104 defining an opening 106 for the vertical disk ferrule 3 (5, 7), which is adequately sized for proper use with the respective wire 30 size, while the vertical disk ferrule 3 (5, 7) has adequate surface on the front face 5*a* and back face 7*a* for proper grounding with a grounding feature and properly functions when in use, the wire 30 remaining flexible behind the ferrule 3 (5, 7). The opening 106 of the vertical disk ferrule 3 (5, 7) is also of a size that allows the vertical disk ferrule 3 (5, 7) to move freely over a wire braided shield 23 of the wire 30, if required, as will be discussed later.

The vertical disk ferrule 3 (5, 7) contacts with respective grounding elements in a respective metallic connector housing 12 at its front vertical face 5*a* or in combination with its front vertical face 5*a* and wire braided shield 23 when used as a single ferrule 3 with a flared portion F of the wire braided shield 23 therebetween. The grounding elements in the respective metallic connector housing 12 may be, for example, plated surfaces, a traditional stamped shield, foil lined surfaces, or other conductive materials utilized within, on, or by the metallic connector housing 12 for grounding purposes. The outer edge 102 of the vertical disk ferrule 3 (5, 7) may also make contact with the grounding elements of a respective metallic connector housing 12, if so desired.

The thickness of the vertical disk ferrule 3 (5, 7), in an axial direction, is defined by the length of the outer edge 102, preferably no more than 1 mm (however, the size and or length thereof is not limited thereto); and the preferred thickness of the vertical disk ferrule 3 (5, 7) in the axial direction is kept thin enough to provide for less required space in a respective connector housing compared to that in a conventional crimped ferrule, being thinner or shorter than a conventional crimped ferrule, and also allowing adequate take-up of the wire 30, as will be discussed further below. The thickness of the vertical disk ferrule 3 (5, 7) further preferably accommodates the vertical disk ferrule 3 (5, 7) within a recess in the respective metallic housing connector housing 12 such that the vertical disk ferrule 3 (5, 7) resides within a portion of the respective metallic connector housing 12 if needed, and thereby providing a much shorter design for the metallic connector housing 12 than conventional ferrules when the connector assembly 1 (30, 60) of this invention is assembled. The vertical disk ferrule 3 (5, 7) may also be accommodated on the exterior of the respective metal connector housing 12 by substantially abutting a surface or side thereof the metallic connector housing 12 (see, FIGS. 1, 2, and 4).

When assembling the high voltage connector assembly 1 (30, 60) of this invention, the wire 30 is pushed into and through the vertical disk ferrule 3 (5, 7), whereby the wire braided shield 23 is pushed back and the wire braided shield 23 is allowed to develop a natural spring force against the vertical disk ferrule 3 (the second vertical disk ferrule (or rearmost vertical disk ferrule) 7 if two vertical disk ferrules 5, 7 are used, as in the first embodiment), and the wire braided shield 23 becomes in the condition or state where it has developed an accordioned, pleated, or folded portion 20 against itself, and therefore pushes back against the direction the vertical disk ferrule 3 (5, 7) has traveled along the wire core 15 when the wire 30 is being pushed, so as to push the vertical disk ferrule 3 (5, 7) forward (or towards the cut end of the wire 30 or terminal 18 attached thereto). This force will allow the vertical disk ferrule 3 (5, 7) and/or wire braided shield 23, if in between the vertical disk ferrule 3 and the metallic connector housing 12, to remain in contact with the grounding structures of the connector housing 12. If, as is the third embodiment (shown in FIG. 4), a single vertical disk ferrule 3 is used, the force pushes the vertical disk ferrule 3 against the wire braided shield 23, which abuts against the grounding feature or metallic connector housing 12.

Shown in FIG. 1 is the first embodiment of the high voltage connector assembly 1 and is the preferable use of two vertical disk ferrules 5, 7. The use of two vertical disk ferrules 5, 7, the first vertical disk ferrule 5 and the second vertical disk ferrule 7, provides the ability to sandwich a flared portion of the wire braided shield 23 of the wire 30 in between the front face 5*a* of the first vertical disk ferrule 5 and the rear face 7*a* of the second vertical disk ferrule 7. The first vertical disk ferrule 5 has been placed over the wire braided shield portion 23, such that the first vertical disk ferrule 5 and the second vertical disk ferrule 7 contact the flared portion F of the wire braided shield 23. The above-described structural arrangement provides adequate contact among the flared portion F of the wire braided shield 23, the first vertical disk ferrule 5, and the second vertical disk ferrule 7. Solder or other mechanical, or electro-mechanical means, (not shown) may be used to further stabilize or promote the sandwiching or insertion of the flared portion F between the first and second vertical disk ferrules 5, 7, and to secure the structural arrangements or relationships of these parts for complete continuity of the EMI path that pass therethrough, as further discussed below.

When using two vertical disk ferrules 5, 7 for the vertical disk ferrule 3, it may further or optimally be desired to securely affix the two vertical disk ferrules 5, 7 together in order to retain and keep the flared portion F of the wire braided shield 23 inserted or sandwiched therebetween, as discussed above. It is preferred that mechanical, or electro-mechanical means are used to connect the two vertical disk ferrules 5, 7 for adequate operation of the two vertical disk ferrules 5, 7. For example, solder, welding (resistive, spot, ultrasonic, or the like), or brazing are electro-mechanical methods that can be used to connect the respective metals which comprise the two vertical disk ferrules 5, 7. Also, a mechanical bond using a press fit or snap fit may be used. The means of securing the two vertical disk ferrules 5, 7 together provides and promotes an adequate conductive and or physical substrate to connect the second vertical disk ferrule 7 to the first vertical disk ferrule 5, and therefore assures the conductive connection and contact of the two vertical disk ferrules 5, 7 (that make up the vertical disk ferrule 3) to the flared portion F or the wire braided shield 23 when or if the first vertical disk ferrule 5 makes contact with the grounding structure in the corresponding metallic connector housing 12. Alternatively, when a single vertical disk ferrule 3 (5, 7) is used (as in the second embodiment and third embodiment of this invention, as illustrated in FIG. 2 and FIG. 4, respectively, the flared portion F of the wire braided shield 23 and the vertical disk ferrule 3 (5, 7) may be soldered together to ensure that they are fixed and secured in combination.

In FIGS. 1 and 2, the use of a terminal 18 on the wire 30 are shown. The terminal 18 is secured to the end of the wire 30 by being fixedly attached (e.g., soldered) to a wire core portion 15 of the wire 30. FIG. 1 shows the vertical disk ferrules employs the two vertical disk ferrules 5, 7; however, the second and third embodiments of the connector assemblies 30, 60 employed in this invention are not limited thereto and the replacement and use of a single vertical disk ferrule 5, 7 can be similarly applied in the structure, structural arrangement, or method of this invention, as illustrated, and as further discussed below.

In the first embodiment (FIG. 1), when the two vertical disk ferrules 5, 7 are used, one rides over the wire shield 23 (the second vertical disk ferrule 7) and the other (the first vertical disk ferrule 5) tides over the core insulation 9. Here, the flared portion F of the wire braided shield 23 is sandwiched between the first and second disk ferrules 5, 7. In the second embodiment (FIG. 2), when one single vertical disk ferrule 3 is used and the flared portion F of the wire braided shield 23 is fixed or against the back face 7*a* of the vertical disk ferrule 3, the vertical disk ferrule 3 rides over the wire core insulation 9. In the third embodiment (FIG. 4), when one single vertical disk ferrule 3 is used and the wire shield 23 is fixed or against the front face 5*a* of the vertical disk ferrule 3, the vertical disk ferrule 3 rides over the wire braided shield 23.

As seen in FIG. 1, in the first embodiment of this invention, the wire braided shield portion 23 of the wire 30 is affixed between two vertical disk ferrules 5, 7. The vertical disk ferrule 3, which is made up of the first and second vertical disk ferrules 5, 7, cannot move along the wire 30 towards the terminal 18 in an axial direction along the wire 30, since the wire shield 23 is extended fully in such a direction that a portion of the wire shield 23 is flat along the insulation 9 of the core portion 15 and the flared end F of the wire braided shield portion 23 is secured and affixed from moving from its position between the two vertical disk ferrules 5, 7. The second vertical disk ferrule 7 rides over the wire braided shield 23 and the first vertical disk ferrule 5 rides over the core insulation 9. The wire 30 extends through the opening 106 of both vertical disk ferrules 5, 7, during what is considered to be the "take-up", which includes the bunching or accordioning (see, portion 20 of the wire braided shield 23) of the wire braided shield 23, which is due to the slack or tolerance for movement of the wire core 15 as it further relates to the exposed length of the wire braided shield 23. The wire braided shield 23 becomes bunched up onto the side of the two vertical disk ferrules 5, 7 opposite the side which the terminal 18 and wire core 15 extend. As the two vertical disk ferrules 5, 7 move along the axial direction of the wire 30, and parallel to the wire 30, the wire core 15 extends, moves along, and through the openings 106 of the two vertical disk ferrules 5, 7. The wire braided shield portion 23 becomes consequently bunched up, or accordioned, as shown by reference number 20, into itself as the "take-up" of the wire 30 occurs. The wire braided shield 23 is bunched up from where it is exposed at the outer insulation 25 of the wire 30 to where it may contact the rear face 7*a* of the second vertical disk ferrule 7.

As seen in FIG. 2, once the wire braided shield portion 23 has become bunched or accordioned, this bunched or accordioned portion 20 of the wire shield 23 provides a force against the rear face 7*a* of the vertical disk ferrule 3 since the wire braided shield 23 becomes pressed onto itself and is compressed while being up against the vertical disk ferrule 3. Thus, this accordioned portion 20 of the wire braided shield portion 23 provides a spring-like force against back face 7*a* of the second vertical disk ferrule 7 of the vertical disk ferrule 3 in FIG. 1 or against the back face 7*a* of the vertical disk ferrule 3 in FIG. 2 when the wire 23 is in this structural arrangement. The force provided by the wire shield 23 provides or assures that the second vertical disk ferrule 7 of the vertical disk ferrule in FIG. 1 or the vertical disk ferrule 3 in FIG. 1 is pressed against a surface of the metallic connector housing 12 and/or against respective shielding means incorporated with the metallic connector housing 12, while the back face 7*a* of the second vertical disk ferrule 7 of the vertical disk ferrule 3 in FIG. 1 or the back face 7*a* of the vertical disk ferrule 3 in FIG. 2 also adequately covers an opening or aperture (not shown) in the metallic connector housing 12.

Figure 3:
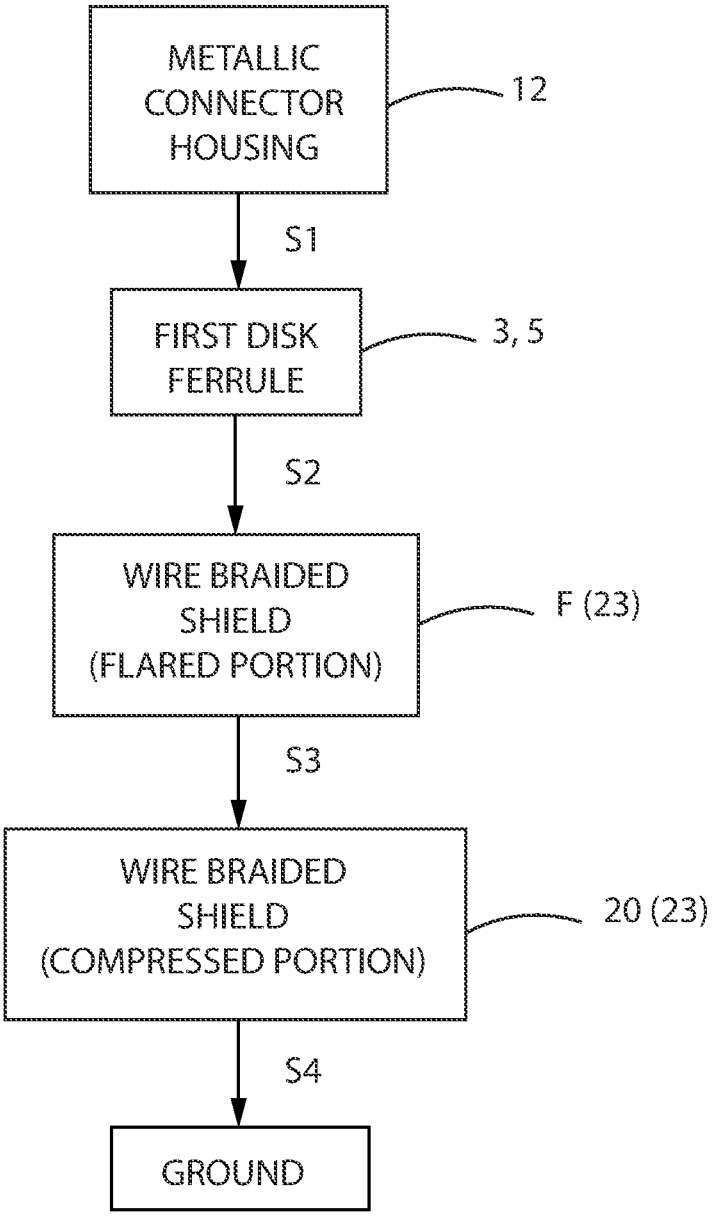
FIG. 3 is a flowchart illustrating the path taken by the EMI along the high voltage connector assembly, which employs either the first embodiment or the second embodiment of the high voltage vertical disk ferrule.

FIG. 3 is a flowchart illustrating the path taken by the EMI along the high voltage connector assembly 1, which employs the first embodiment of the high voltage vertical disk ferrule 3 (5, 7). As shown in FIG. 3 (see also, FIG. 1), the EMI, in Step 1 (S1), travels from the metallic connector housing 12 to the first high voltage disk ferrule 5 of the high voltage disk ferrule 3, and then, in Step 2 (S2), to the flared portion F of the wire braided shield 23. Here, because the flared portion F of the wire braided shield 23 is connected to the compressed portion 20 of the wire braided shield 23, the EMI, in Step 3 (S3), travels directly from the flared portion F to the compressed portion 20 of the wire braided shield 23. Thereafter, in Step 4 (S4), the EMI travels from the compressed portion 20 of the wire braided shield 23 to ground.

In the second embodiment of the high voltage connector assembly 30 of this invention, as shown in FIG. 2, the flared portion F of wire braided shield 23 of the wire 30 is affixed to the back face 7*a* of the single vertical disk ferrule 3. Once the flared portion F of the wire braided shield 23 is attached, the vertical disk ferrule 3 cannot move along the wire 30 further forward towards the terminal 18 in an axial direction along the wire 30, since the wire braided shield 23 is extended or stretched fully in such a direction that a portion of the wire braided shield 23 is taught and flat along the wire core insulation 9 of the wire core 15 and the flared portion F of the wire braided shield portion 23 is secured and affixed from moving from its position on the vertical disk ferrule 3, and may be further affixed to the back face 7*a* of the vertical disk ferrule 3 using solder. Further, the wire braided shield 23 may also not be secured or affixed to the vertical disk ferrule 3; however it will likewise move away from the flared portion F of the wire braided shield portion 23. However, in the affixed condition with the wire shield 23, the single vertical disk ferrule 3 (in the second embodiment shown in FIG. 2) is movable in an axial direction towards the outer wire insulation portion 25, and away from the cut end of the wire or attached terminal 18. Thus, when the one single vertical disk ferrule 3 is used and the wire braided shield 23 is fixed or against the back face 7*a* of the vertical disk ferrule 3, the vertical disk ferrule 3 rides over the wire core insulation 9 and does not ride over the wire braided shield 23. Consequently, the wire 30 extends through the opening 106 of the vertical disk ferrule 3, during what is considered to be the "take-up", which includes the bunching or accordioning (portion 20 of the wire braided shield 23) of the wire braided shield 23, which is due to the slack or tolerance for movement of the wire core 15 as it further relates to the exposed length of the wire braided shield 23. The wire braided shield 23 becomes bunched up onto the side of the vertical disk ferrule 3 opposite the side which the terminal 18 and wire core 15 extend, which is from the front face 5*a* of the high voltage vertical disk ferrule 3. As the vertical disk ferrule 3 moves along the axial direction of the wire 30, along the wire core insulation 9, and parallel to the wire 30, the wire core 15 extends, moves along, and through the opening 106 of the vertical disk ferrule 3. The wire braided shield portion 23 will consequently bunch up, or accordion (see, portion 20 of the wire braided shield 23) into itself as the "take-up" of the wire 30 occurs. The wire braided shield 23 is bunched up from where it is exposed at the outer insulation 25 of the wire 30 to where it may contact the rear face 7 of the vertical disk ferrule 3. As further shown in FIG. 2, once the wire braided shield 23 has become bunched or accordioned (as in portion 20 of the wire braided shield 23), this portion 20 of the wire braided shield 23 provides a force against the rear face 7*a* of the vertical disk ferrule 3 since the wire braided shield 23 is now pressed onto itself and is compressed while abutting against the vertical disk ferrule 3. Thus, more specifically, the wire braided shield 23 is bunched or accordioned in the space between the vertical disk ferrule 3 and the outer insulation 25, whereby the exposed portion of the wire braided shield 23 extends along the wire core insulation 9, and the end portion (or flared portion F) of the wire braided shield 23 is between the vertical disk ferrule 3 and the accordioned portion 20 of the wire braided shield 23. Thus, this accordioned portion 20 of the wire braided shield 23 provides a spring-like force against the vertical disk ferrule 3 when the wire 30 is in this condition. The spring force provided by the wire braided shield 23 provides or assures that the front face 5*a* of the vertical disk ferrule 3 is pressed against and contacts a surface of the metallic connector housing 12 and against such respective shielding means (not shown) inside or of the metallic connector housing 12, while the vertical disk ferrule 3 further and also adequately covers an opening or aperture (not shown) in the metallic connector housing 12.

Similarly applicable in the second embodiment in the high voltage connector assembly 30 of this invention is the EMI path shown in the flowchart of FIG. 3. The flowchart in FIG. 3, with respect to the second embodiment of this invention, illustrates the path taken by the EMI along the high voltage connector assembly 30, which employs the second embodiment with the single use of the high voltage vertical disk ferrule 3. As shown in FIG. 3 (see also, FIG. 2), the EMI, in Step 1 (S1), travels from the metallic connector housing 12 to the high voltage disk ferrule 3, and then, in Step 2 (S2), to the flared portion F of the wire braided shield 23. Here, because the flared portion F of the wire braided shield 23 is connected to the compressed portion 20 of the wire braided shield 23, the EMI, in Step 3 (S3) travels directly from the flared portion F to the compressed portion 20 of the wire braided shield 23. Thereafter, in Step 4 (S4), the EMI travels from the compressed portion 20 of the wire braided shield 23 to ground.

As illustrated in FIG. 4, the flared portion F of the wire braided shield 23 of the wire 30 is affixed to the front face 5*a* of the single vertical disk ferrule 3. Once the flared portion F of the wire braided shield 23 is attached, the vertical disk ferrule 3 cannot move along the wire 30 further forward towards the terminal 18 in an axial direction along the wire 30, since the wire braided shield 23 is extended or stretched fully in such a direction that a portion of the wire braided shield 23 is taught and flat along the wire core insulation 9 of the core portion 15 and the flared portion F of the wire braided shield 23 is secured and affixed from moving from its position on the vertical disk ferrule 3, and may be further affixed to the front face 5*a* of the vertical disk ferrule 3 using solder, or the like. Further, the wire braided shield 23 may also not be secured or affixed to the vertical disk ferrule 3, however it will likewise move away from the flared portion F of the wire braided shield portion 23. However in the affixed condition with the wire braided shield 23, the single vertical disk ferrule 3 is movable in an axial direction towards a vertical portion of the outer wire insulation 25, and away from the cut end of the wire or attached terminal 18. Thus, when one single vertical disk ferrule 3 is used and the wire braided shield 23 is fixed or against the front face 5*a* of the vertical disk ferrule 3, the vertical disk ferrule 3 rides over the wire braided shield 23. Here, the wire extends through the opening 106 (see, FIG. 6) of the vertical disk ferrule 3, during what is considered to be the "take-up", which includes the bunching or accordioning of the portion 20 of the wire braided shield 23, which is due to the slack or tolerance for movement of the wire core 15 as it further relates to the exposed length of the wire braided shield 23. The wire braided shield 23 becomes bunched up onto the side of the vertical disk ferrule 3 opposite the side which the terminal 18 and wire core 15 extend, which is from the front face 5*a* of the vertical disk ferrule 3. As the vertical disk ferrule 3 moves along the axial direction of the wire 30, along the wire braided shield 23, and parallel to the wire 30, the wire core 15 extends, moves along, and through the opening 106 of the vertical disk ferrule 3. The wire braided shield 23 consequently bunches up, or accordions, as shown in portion 20 of the wire braided shield 23 into itself as the "take-up" of the wire 30 occurs. The wire braided shield 23 is bunched up from where it is exposed at the outer insulation 25 of the wire 30 to where it may contact the rear face 7*a* of the vertical disk ferrule 3. As shown in FIG. 4, once the wire braided shield 23 has become bunched or accordioned, as in portion 20 thereof, this portion 20 of the wire braided shield 23 provides a force against the rear face 7*a* of the vertical disk ferrule 3 since the wire braided shield 23 is now pressed onto itself and is compressed while abutted against the vertical disk ferrule 3. Thus, more specifically, the wire braided shield 23 is bunched or accordioned in the space between the vertical disk ferrule 3 and the outer insulation 25, whereby the exposed portion of the wire braided shield 23 extends along the wire core insulation 9, and the flared portion F of the wire braided shield 23 is between the vertical disk ferrule 3 and metallic connector housing 12. Thus, this accordioned portion 20 of the wire braided shield 23 provides a spring-like force against the vertical disk ferrule 3 when the wire 30 is in this condition. The spring force provided by the wire braided shield 23 provides or assures that the front face 5*a* of the vertical disk ferrule 3 is pressed against and contacts the flared portion F of the wire braided shield 23, or if the wire braided shield 23 is further affixed using affixing means or being soldered, that the wire braided shield 23 is ensured to make adequate contact with the surface of the metallic connector housing 12 and against such respective shielding means (not shown) inside or of the metallic connector housing 12, while the vertical disk ferrule 3 further and also adequately covers an opening or aperture (not shown) in the metallic connector housing 12.

Figure 5:
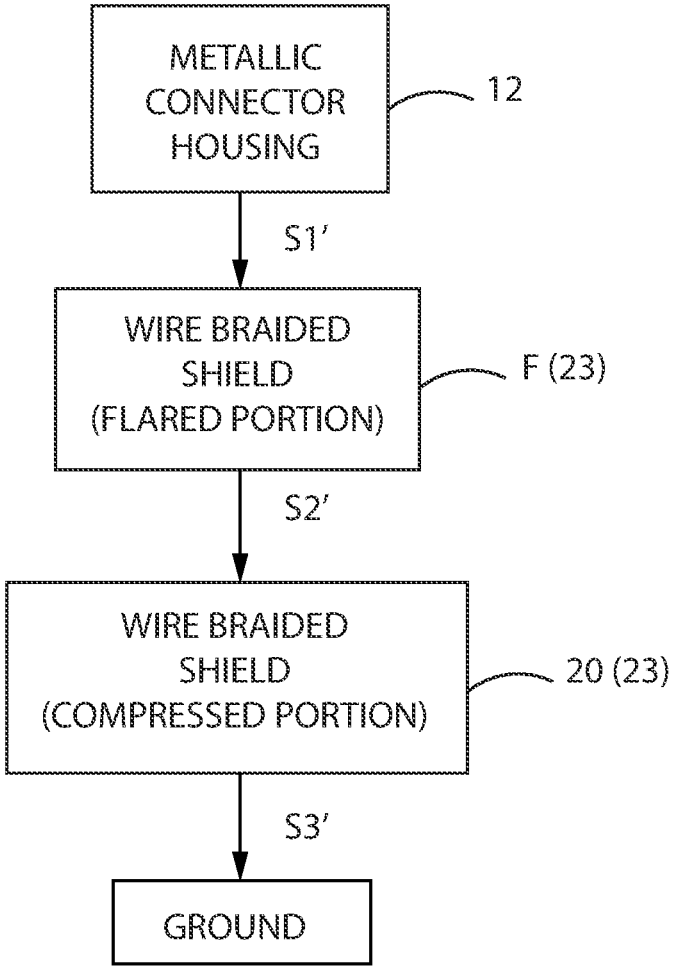
FIG. 5 is a flowchart illustrating the path taken by the EMI along the high voltage connector assembly, which employs the third embodiment of the high voltage vertical disk ferrule.

FIG. 5 is a flowchart illustrating the path taken by the EMI along the high voltage connector assembly 60, which employs the third embodiment of the high voltage vertical disk ferrule 3. As shown in FIG. 5, the EMI, in Step 1' (S1'), travels from the metallic connector housing 12 directly to the flared portion of the wire braided shield 23, the flared portion F abutting and contacting the metallic connector housing 12. The EMI, in Step 2' (S2'), then travels from the flared portion F directly to the compressed portion 20 of the wire braided shield 23, the flared portion F of the wire braided shield 23 being connected to the compressed portion 20 of the wire braided shield 23. In Step 3' (S3'), the EMI travels directly from the compressed portion 20 of the wire braided shield 23 to ground.

The high voltage vertical disk ferrule 3 (5, 7) employed in the high voltage connector 1, 30, 60 of this invention also increases the electrical clearance when in operation. In other words, by allowing the vertical disk ferrule 3 (5, 7) and the wire braided shield 23 (grounding circuit) to reside further away from the terminal 18 or wire core 15 (power circuit) as a result of the travel distance of the wire 30 into the metallic connector housing 12, and the extension of the terminal 18 or wire core 15 away from the vertical disk ferrule 3 (5, 7), the electrical clearance is increased from those two components; and thus, in comparison to conventional ferrule structural arrangement and assembly, which has a conventional ferrule closer to the attached terminal.

The present invention is not limited to the above-described embodiments; and various modifications in design, structural arrangement or the like may be used without departing from the scope or equivalents of the present invention. Although the foregoing descriptions are directed to the preferred embodiments of the invention, it is noted that other variations and modifications will be apparent to those skilled in the art, and may be made without departing from the spirit or scope of the invention. Moreover, structural arrangements or features described in connection with one embodiment of the invention may be used in conjunction with other embodiments, even if not explicitly stated above.

We claim:

1. A method for reducing the effect of electromagnetic interference (EMI) to provide EMI protection to a connector assembly having at least one vertical disk ferrule, said method comprising the steps of:

providing said connector assembly with a wire braided shield between an outer insulation of a wire and said at least one vertical disk ferrule, and said at least one vertical disk ferrule between said wire braided shield and a metallic connector housing that houses a wire core of said wire;

conducting said EMI, generated by at least said metallic connector housing, to said at least one vertical disk ferrule;

conducting said EMI from said at least one vertical disk ferrule to said wire braided shield; and thereafter conducting said EMI from said wire braided shield to a ground, wherein said step of providing said connector assembly with said braided shield includes a step of providing said wire braided shield with at least a first portion and a second portion, wherein said first portion of said wire braided shield is a flared portion, and wherein said second portion of said wire braided shield is an accordioned, pleated, or folded portion.

2. The method for reducing the effect of electromagnetic interference (EMI) to provide EMI protection to a connector assembly having at least one vertical disk ferrule according to claim 1, wherein said step of conducting said EMI, generated by at least said metallic connector housing, to said at least one vertical disk ferrule includes a step of conducting said EMI from said metallic connector housing to a first of two vertical disk ferrules.

3. The method for reducing the effect of electromagnetic interference (EMI) to provide EMI protection to a connector assembly having at least one vertical disk ferrule according to claim 2, further including a step of conducting said EMI from said first disk ferrule to said wire braided shield.

4. The method for reducing the effect of electromagnetic interference (EMI) to provide EMI protection to a connector assembly having at least one vertical disk ferrule according to claim 1, wherein said step of conducting said EMI from said at least one of said vertical disk ferrule includes a step of conducting said EMI from said at least one of said vertical disk ferrule to said flared portion of said wire braided shield, and then to said accordioned, pleated, or folded portion of said wire braided shield.

5. The method for reducing the effect of electromagnetic interference (EMI) to provide EMI protection to a connector assembly having at least one vertical disk ferrule according to claim 1, wherein said step of conducting said EMI from said wire braided shield to said ground includes a step of conducting said EMI from said accordioned, pleated, or folded portion of said wire braided shield to said ground.

6. The method for reducing the effect of electromagnetic interference (EMI) to provide EMI protection to a connector assembly having at least one vertical disk ferrule according to claim 1, wherein said step of providing said connector assembly includes a step of sandwiching said flared portion of said wire braided shield between two vertical disk ferrules, and providing said accordioned, pleated, or folded portion of said wire braided shield between said vertical disk ferrules and said outer insulation of said wire.

7. The method for reducing the effect of electromagnetic interference (EMI) to provide EMI protection to a connector assembly having at least one vertical disk ferrule according to claim 6, said two vertical disk ferrules that sandwich said flared portion of said wire braided shield contacts or abuts said metallic connector housing, and are provided between said metallic connector housing and said accordioned, pleated, or folded portion of said wire braided shield.

8. The method for reducing the effect of electromagnetic interference (EMI) to provide EMI protection to a connector assembly having at least one vertical disk ferrule according to claim 1, wherein said step of providing said connector assembly includes a step of contacting or abutting said vertical disk ferrule onto said metallic connector housing, and placing said flared portion of said wire braided shield between said vertical disk ferrule and said accordioned, pleated, or folded portion of said wire braided shield, said accordioned, pleated, or folded portion of said wire braided shield being placed between said flared portion of the said wire braided shield and said outer insulation of said wire.

9. The method for reducing the effect of electromagnetic interference (EMI) to provide EMI protection to a connector assembly having at least one vertical disk ferrule according to claim 1, further comprising a step of providing a spring force by said wire braided shield for assuring that said vertical disk ferrule is pressed against and contacts said metallic connector housing.

10. The method for reducing the effect of electromagnetic interference (EMI) to provide EMI protection to a connector assembly having at least one vertical disk ferrule according to claim 1, further comprising a step of providing a spring force by said wire braided shield for assuring that a flared portion of said wire braided shield is pressed against and contacts said vertical disk ferrule.

11. A method for reducing the effect of electromagnetic interference (EMI) to provide EMI protection to a connector assembly having at least one vertical disk ferrule, said method comprising the steps of:

providing said connector assembly with a first portion of a wire braided shield between said vertical disk ferrule and a metallic connector housing that houses a wire core of a wire, and a second portion of said wire braided shield between said vertical disk ferrule and an outer insulation of said wire;

conducting said EMI, generated by at least said metallic connector housing, to said first portion of said wire braided shield;

conducting said EMI from said first portion of said wire braided shield to said second portion of said wire braided shield; and thereafter conducting said EMI from said second portion of said wire braided shield to a ground, wherein said first portion of said wire braided shield is a flared portion, and wherein said second portion of said wire braided shield is an accordioned, pleated, or folded portion.

12. The method for reducing the effect of electromagnetic interference (EMI) to provide EMI protection to a connector assembly having at least one vertical disk ferrule according to claim 11, further comprising a step of providing a spring force by said wire braided shield for assuring that a flared portion of said wire braided shield is pressed against and contacts said metallic connector housing.

13. The method for reducing the effect of electromagnetic interference (EMI) to provide EMI protection to a connector assembly having a least one vertical disk ferrule according to claim 11, further comprising a step of providing a spring force by said wire braided shield for assuring that said vertical disk ferrule is pressed against and contacts a flared portion of said wire braided shield.

* * * * *